US005215307A

United States Patent [19]

Huffman

[11] Patent Number: 5,215,307

[45] Date of Patent: Jun. 1, 1993

[54] GOLF SWING TRAINING EXERCISE METHOD

[75] Inventor: Larry C. Huffman, Des Moines, Iowa

[73] Assignee: Concept Sports, Inc., Des Moines, Iowa

[21] Appl. No.: 926,052

[22] Filed: Aug. 5, 1992

[51] Int. Cl.[5] ..... A63B 69/36

[52] U.S. Cl. ..... 273/193 A; 273/26 R; 273/29 A

[58] Field of Search ..... 273/193 A, 193 B, 194 A, 273/194 B, 35, 81 R, 26 B, 186 A, 81 A, 77 A, 81 B, 81 C, 165, 166, 81.2, 81.3, 81.4, 80 A; 482/92, 93, 97, 98, 106, 107, 108

[56] References Cited

U.S. PATENT DOCUMENTS

| | | | |
|---|---|---|---|
| 1,138,196 | 5/1915 | Diehl . | |
| 1,664,257 | 3/1928 | McCullough | 273/81.4 |
| 2,331,281 | 1/1966 | Wallo | 273/193 A |
| 4,029,312 | 6/1977 | Wright | 272/123 |
| 4,203,598 | 5/1980 | Stuff | 273/77 A |
| 4,461,479 | 8/1984 | Mitchell | 273/81 A |
| 4,555,111 | 11/1985 | Alverez | 273/26 B |
| 4,600,195 | 8/1986 | Hunter | 273/81 A |
| 4,602,788 | 7/1986 | Wendt | 273/193 A |
| 4,602,788 | 7/1986 | Wendt | 273/193 |
| 4,682,773 | 8/1987 | Pomilia | 273/26 B |
| 4,878,673 | 11/1989 | Pollard | 273/186 |
| 4,887,815 | 12/1989 | Hughes | 273/77 A |
| 5,026,063 | 6/1991 | Rhode | 273/193 A |
| 5,083,790 | 1/1992 | Wheatley | 273/193 A |
| 5,121,925 | 6/1992 | Blundo | 273/193 A |

OTHER PUBLICATIONS

Fungo Bat for Golfers Builds Forearm Strength; Grooves Your Grip and Swing as You Exercise Indoors! #G570 Protator, p. 38.

*Primary Examiner*—Theatrice Brown
*Attorney, Agent, or Firm*—Zarley, McKee, Thomte, Voorhees, & Sease

[57] ABSTRACT

A golfer, tennis player or baseball player is able to maintain normal balance while swinging a counter weighted training device in a fashion normal to the sport in question. The appropriate grip is placed on a shaft having oppositely disposed weights on each end. The amount of weight on each end may be varied but one of the weights is always between the user's hands and body while swinging the training device thereby allowing the user to maintain normal balance throughout the swing of the training device.

7 Claims, 2 Drawing Sheets

GOLF SWING TRAINING EXERCISE METHOD

BACKGROUND OF THE INVENTION

Weight training to build up body muscles is popular among many athletes. Weight training exercises specific to a particular sport, however, are less common. In golf, weighted golf clubs have been used but the additional weight on the end of the golf club shaft adversely affects the balance of the golfer. The weight tends to pull the golfer toward the weight. Representative of other weighted exercise devices for improving the golf swing is the device disclosed in the Pollard U.S. Pat. No. 4,878,673 which shows a pair of training sticks with each stick being held at one end by a different hand. The other end of the stick has a weighted ball connected by a flexible cable.

What is needed is a weighted exercise device that will allow the user to practice the specific swing of a given sport such as golf, tennis or baseball but not affect the balance of the user while performing the exercise. The weights used should be sufficient to strengthen the specific muscles required for the specific sport in question.

SUMMARY OF THE INVENTION

This invention provides a counter balanced shaft having a grip for the specific desired sport and the opposite ends of the shaft carry counter balanced weights. In golf, a conventional golf grip may be provided between the weights on the shaft or a training grip which specifically positions the golfer's hands in a correct position may be used. The tennis exercise device utilizes a conventional tennis racket handle and grip between the counter balanced weights. In baseball, a baseball bat handle is provided on the shaft carrying the counter balanced weights at opposite ends.

The counter balancing of weights on a golf club, tennis racket or baseball bat is critical to maintaining balance during the swing particularly when heavier weights are being used. The weights may be easily interchanged as they are threadably attached to the shaft. The weights are cylindrical and elongated and their length will vary with their weight. As appropriate, the weight at one end may be different from the weight at the opposite end. The effective length of the exercise device is substantially less than the conventional golf club and is also less than a tennis racket or a baseball bat. This length will ordinarily vary between 15 and 30 inches. The individual weights will vary between approximately two and six pounds.

DESCRIPTION OF PREFERRED EMBODIMENT

Figure 1:
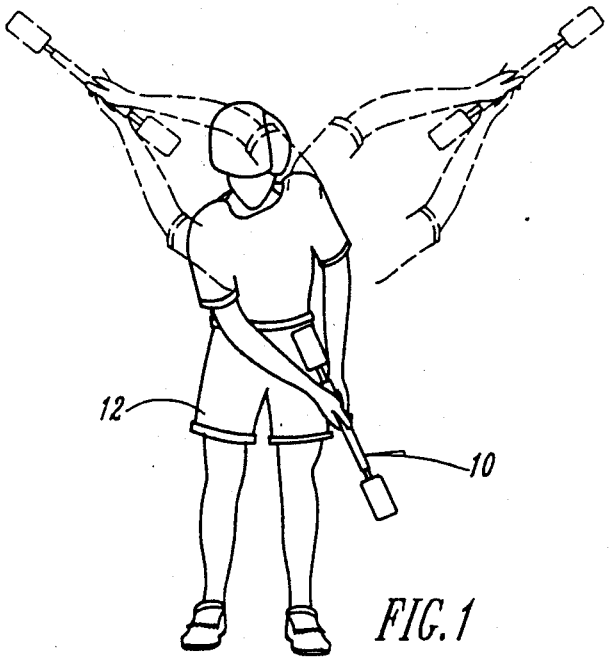
FIG. 1 is a front view of a golfer practicing a golf swing using the counter balanced swing training device of this invention.
Figure 2:
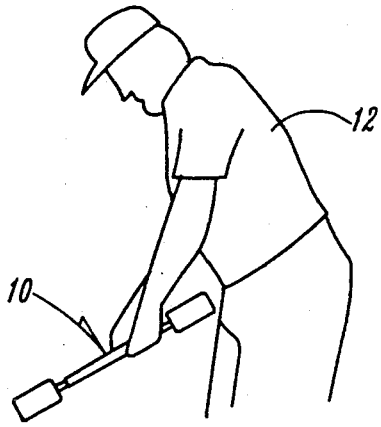
FIG. 2 is a side view of the golfer of FIG. 1.
Figure 3:
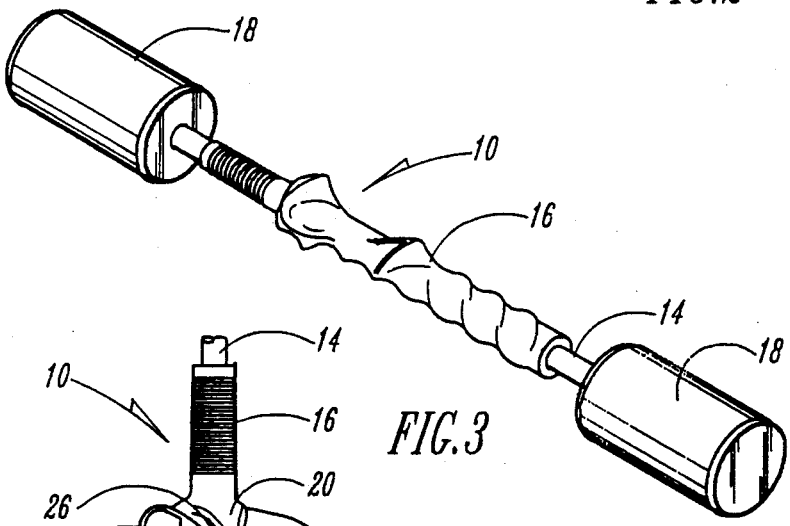
FIG. 3 is perspective view of a counter balanced golf swing training device.
Figure 4:
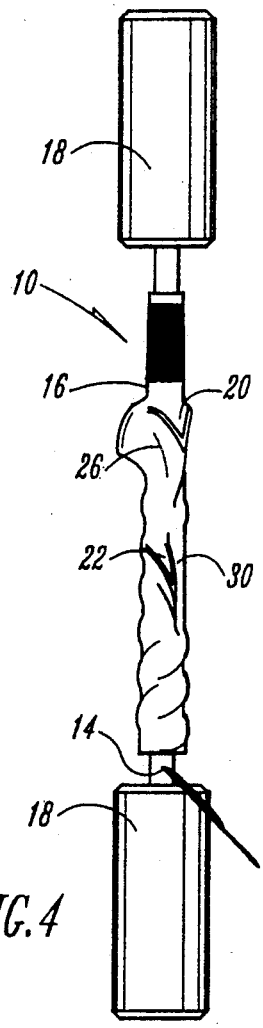
FIG. 4 is a top plan view of the counter balanced golf swing training device.

The counter balanced golf swing training device of this invention is referred to in FIG. 3 generally by the reference numeral 10 and is shown in use in FIGS. 1 and 2 by a golfer 12. It is seen that the device 10 is held and swung like a conventional golf club.

The counter balanced golf swing training device 10 includes a shaft 14 having a golf grip 16 and elongated cylindrical solid weights 18 threadably connected at opposite ends of the shaft 14.

Figure 5:
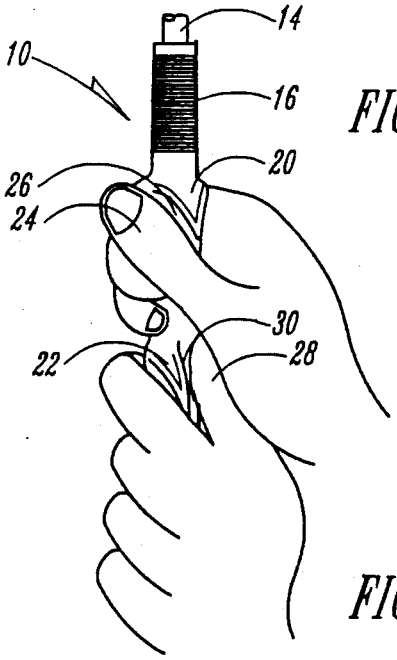
FIG. 5 is an enlarged fragmentary perspective view of the golf grip showing the hands positioned thereon.

The golf grip 16 may be that of a conventional golf club or a training grip as seen in FIGS. 1–5. The training grip 16 includes a front V-shaped shoulder 20 and a rear V-shaped shoulder 22. The thumb 24 of the right hand is pressed against one side 26 of the front shoulder 20 while the thumb 28 of the left hand is pressed against the opposite side of the rear shoulder 22 as seen in FIG. 5. The grip 16 assures that the golfer uses the correct golf grip when using the counter balanced golf swing training device 10.

Use of the counter balanced golf swing training device 10 as illustrated in FIGS. 1 and 2 not only grooves the swing, but substantially strengthens the muscles used for the golf swing thereby providing the golfer with a greater potential to hit the ball a longer distance. As a golfer ages, strength and distance may be maintained or increased by exercising with the counter balanced golf swing training device 10 of this invention.

Figure 6:
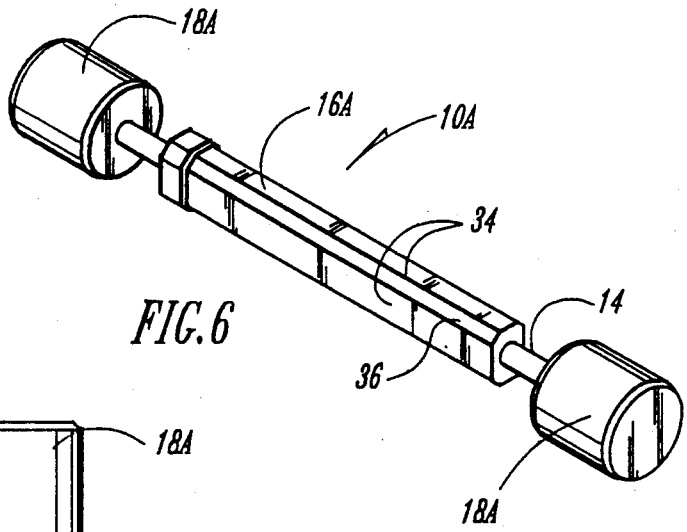
FIG. 6 is a perspective view of a counter balanced tennis swing training device.
Figure 7:
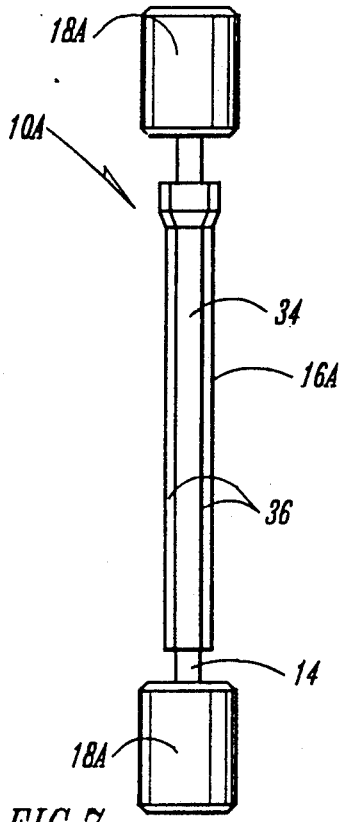
FIG. 7 is a top plan view thereof.

In FIGS. 6 and 7 a counter balanced tennis swing training device 1OA is shown having a tennis handle grip 16A. The weights 18A are shown smaller to illustrate that the weights may be varied in length and weight as desired. The user's hands are both placed on the tennis grip 16A as a two handed tennis player typically does during actual play. The grip 16A has four flat surfaces 34 with beveled corner surfaces 36 therebetween.

Figure 8:
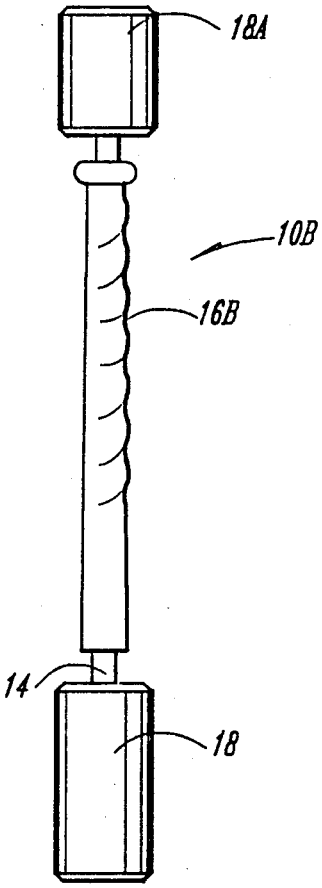
FIG. 8 is a top plan view of a counter balance baseball swing training device.
Figure 9:
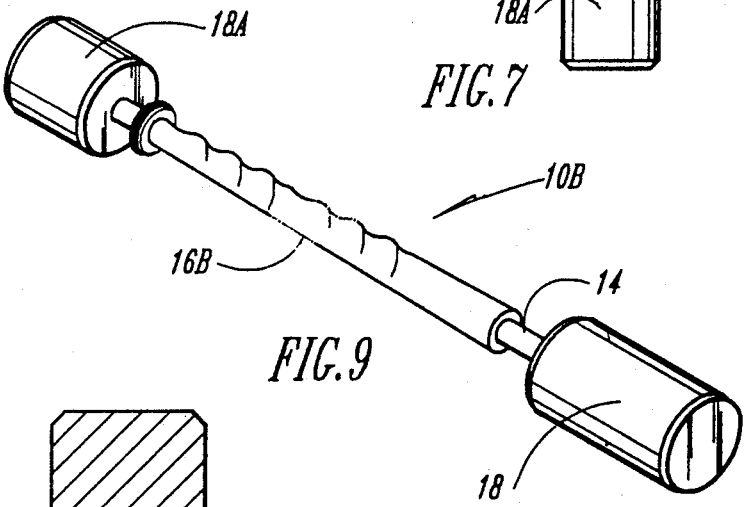
FIG. 9 is a perspective view thereof.
Figure 10:
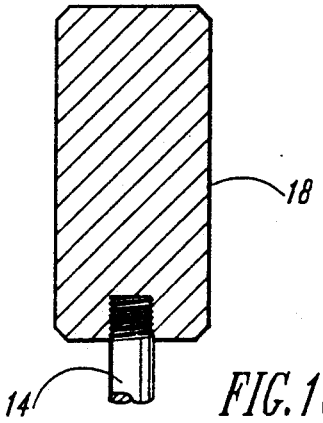
FIG. 10 is an enlarged cross sectional view of a weight at one end of the shaft showing it threadably connected thereto.

A counter balanced baseball swing training device is shown in FIGS. 8 and 9 and is referred to generally by the reference number 1OB. The baseball swing training device 1OB includes a conventional baseball handle grip 16B on the shaft 14. For illustrative purposes, a small weight 18A is provided at one end of the shaft 14 with the heavier, longer weight 18 being provided at the opposite end between the user's hand and body.

It is thus seen in use that whether it be golf, tennis or baseball, the user is able to practice the natural swing of his or her sport without adversely affecting balance during the swing regardless of the weight used. The key is the counter balanced weights at opposite ends of the shaft with one of the weights being between the hands on the grip and the user's body. The position of this weight allows for maintenance of the user's balance during a normal swing specific to the sport in question.

What is claimed is:

1. A method of training a person to properly swing a golf club and strengthen the muscles for swinging a golf club comprising the steps of;

providing a counterbalanced golf club training device having an elongated shaft with a golf grip located between substantially similar, symmetrical about the longitudinal axis of said shaft, counterbalanced weights on opposite ends thereof, said weights having no ball striking face thereon for striking a golf ball, and performing the backswing, downswing and follow-through of a golf club swing to simulate hitting a golf ball from a golf tee without striking a golf ball while one of said weights is spaced a substantial distance above a ball teed position.

2. The method of claim 1 wherein each of said weights weigh between 2 and 6 pounds.

3. The method of claim 1 wherein the length of the training device is between 15 and 30 inches.

4. The method of claim 1 wherein each of said weights are cylindrical in shape.

5. The method of claim 1 wherein each of said weights is threadably attached to opposite ends of said shaft.

6. The method of claim 1 wherein said grip includes a pair of longitudinally front and rear spaced apart V-shaped shoulders and the thumb of the right hand is placed against one side of the front shoulder and the thumb of the other hand is placed against the other side of the rear shoulder while gripping and swinging the training device to practice the proper golf grip on a golf club.

7. The method of claim 1 wherein each of said weights is elongated, cylindrical, solid and threadably attached to opposite ends of said shaft.

* * * * *